United States Patent [19]

Kongoh et al.

[11] Patent Number: 4,599,962

[45] Date of Patent: Jul. 15, 1986

[54] ELECTRONIC SEWING MACHINE

[75] Inventors: Takeshi Kongoh; Haruhiko Tanaka, both of Tokyo, Japan

[73] Assignee: Janome Sewing Machine Industry Co., Ltd., Tokyo, Japan

[21] Appl. No.: 605,689

[22] Filed: Apr. 30, 1984

[30] Foreign Application Priority Data

Apr. 30, 1983 [JP] Japan ..... 58-74928

[51] Int. Cl.[4] ..... D05B 3/02

[52] U.S. Cl. ..... 112/454; 112/456

[58] Field of Search ..... 112/158 E, 454, 453, 112/456, 458, 121.11, 121.12

[56] References Cited

U.S. PATENT DOCUMENTS 4,389,954 6/1983 Makabe et al. ..... 112/158 E 4,413,574 11/1983 Hirota et al. ..... 112/158 E

*Primary Examiner*—Peter Nerbun

*Attorney, Agent, or Firm*—Frishauf, Holtz, Goodman & Woodward

[57] ABSTRACT

A control circuit of an electronic sewing machine is operated such that, in response to a pulse signal determining the common base stitching line of a selected combination of stitch patterns having different base stitching lines, a corresponding base stitching line control data is read out from an electronic memory for producing the selected combination of stitch patterns in series in reference to the single base stitching line thus determined.

10 Claims, 6 Drawing Figures

ELECTRONIC SEWING MACHINE

BACKGROUND OF THE INVENTION

This invention relates to an electronic sewing machine of a type wherein there is provided an electronic memory for storing data to control the lateral needle swing amplitude and the amount of fabric feed per stitch for a selected one or a selected combination of different stitch patterns which may be selected by manipulation of a pattern selecting switch, and more particularly to an electronic sewing machine especially adapted to sequentially produce a combination of different stitch patterns.

In an electronic sewing machine, each stitch pattern will be automatically produced in the maximum size thereof, that is within a predetermined maximum stitching region traversed by a laterally swingable needle. The size may be desirably reduced to a preferred size by manually operating an adjusting dial provided on a front panel of the sewing machine. Each stitch pattern has its own base or reference stitching line determined in accordance with the configuration and/or characteristics thereof. For example, a simple zigzag stitch pattern will have an intermediate base line across which the needle swings to produce the zigzag stitches. With respect to a hem stitch pattern, the needle is made to swing from the left-most line of the maximum stitching region to the right, the said leftmost base line being close to the edge of the superimposed materials to be combined together. With respect to a letter stitch pattern, it is generally preferable to place the base stitching line under the letter, i.e., at the leftmost position of the maximum stitching region just like a floral pattern as shown in FIG. 3B. When producing a selected combination of different stitch patterns having different base stitching lines as above described, and moreover when the needle adjusting dial is operated to reduce the size, the completed stitch patterns as a whole will show an undesirable appearance.

SUMMARY OF THE INVENTION

Therefore the invention has been provided to eliminate the problems which have been often encountered in the formation of sequentially combined different stitch patterns. An object of the invention is to provide an electronic sewing machine capable of producing a combination of different stitch patterns with a beautiful appearance, even when they are sequentially stitched with the lateral needle swing amplitude having been decreased to provide patterns reduced in size.

BRIEF DESCRIPTION OF THE DRAWINGS

The foregoing as well as other objects and advantages of the invention can be fully understood from the following detailed description when read in conjunction with the accompanying drawings in which:

FIGS. 3A through 3D show examples of combinations of different stitch patterns produced by the electronic sewing machine of the invention, wherein FIG. 3A shows the patterns reduced toward the base stitching line M, FIG. 3B shows a size reduction of a sequence of patterns which includes a letter pattern, FIG. 3C shows the patterns reduced in size and referenced toward the base stitching line R and FIG. 3D shows the patterns reduced toward the base stitching line M.

PREFERRED EMBODIMENT OF THE INVENTION

Figure 1:
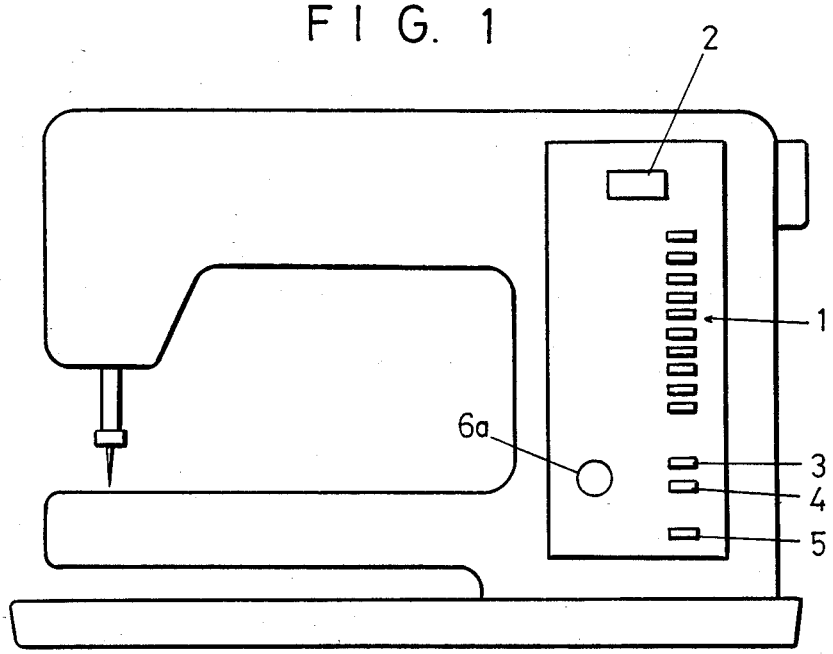
FIG. 1 is a front elevational view of an electronic sewing machine of the invention.
Figure 3A:
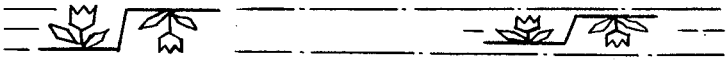
Figure 3B:
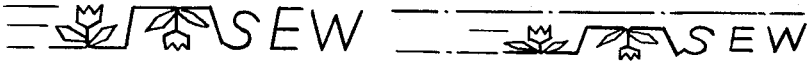

FIG. 1 illustrates a sewing machine of the invention. The sewing machine has therein an electronic memory for storing stitch control data for a number of different stitch patterns. A desired may be selected by operation of pattern selecting switches 1 to designate a corresponding pattern number thereof. The selected pattern number is indicated at a digital indicator 2. When it is desired to sequentially produce a selected combination of different stitch patterns, the sewing machine operator is required to selectively operate the pattern selecting switches 1 to designate the corresponding pattern numbers, and then to operate a memory switch 3 each time a pattern selecting switch is operated, so that the selected pattern numbers are successively memorized in the desired order in a pattern number control unit 7 (see FIG. 2). A second memory switch 4 may be operated in place of the switch 3, when it is desired to laterally invert the selected pattern (as shown, for example, in FIG. 3A). The memory switch is, however, designed to displace the selected pattern, especially when it is a letter pattern, in a reduced condition, for example, to $\frac{2}{3}$ in the height of the maximum size of the letter pattern, as shown in FIG. 3B. The numeral 5 denotes a cancel switch for cancelling the patterns memorized by operation of the memory switch 3 or 4, and for returning the sewing machine to be ready for straight stitching operation. The needle lateral amplitude is selectively adjusted toward or away from the base line of the patterns by operation of an adjusting dial *6a* of an amplitude adjusting unit 6, (see FIG. 2). The size of the stitch pattern may, thus, be reduced from the automatically controlled size to a desired one.

Figure 2:
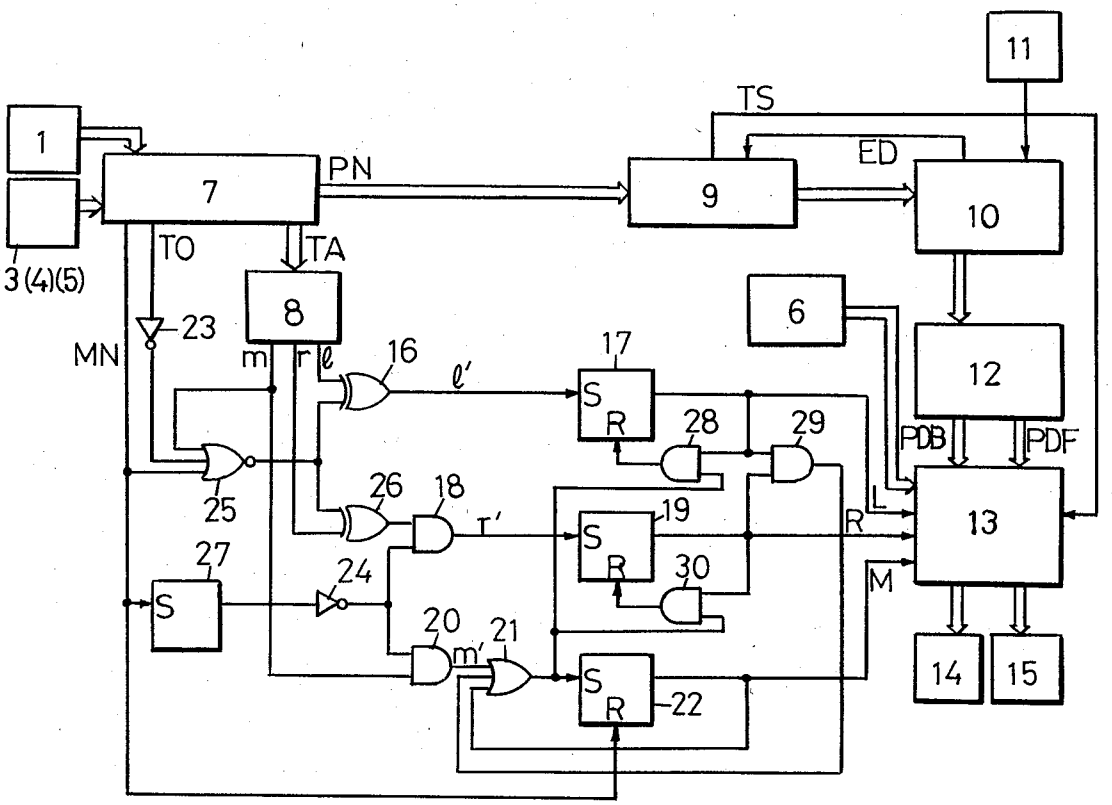
FIG. 2 is a block diagram of a control circuit of the invention.

FIG. 2 is a block diagram of a control circuit according to the invention. More particularly, the selective operation of the pattern selecting switches 1 to select a desired one of the stitch patterns will give a corresponding pattern number signal to a pattern number control unit 7. It produces an address signal TA of the selected stitch pattern to a base stitching line data memory 8. The control unit 7 is also operated to read out the condition of the memory switches 3 and 4, thereby producing the "H" level inverting signal TO when the second memory switch 4 is operated with respect to the selected pattern of a design, and "H" level monogram signal MN when a letter pattern is memorized. The control unit 7 will simultaneously produce the pattern number signals PN of the selected combination of the stitch patterns, to a pattern number memory 9 in which the pattern number signals PN are successively stored in the order as determined by the operator. The first pattern number signal thus memorized in the memory 9 is then transmitted to an address control unit 10. In response to the end signal ED supplied from the control unit 10 each time the formation of a stitch pattern is completed, the pattern number memory 9 will produce the next pattern number signal, and the inverting signal TS if the next pattern is to be inverted. The control unit 10 receives a pulse signal from a drive shaft phase signal generator 11 each time the needle ascends to reach above the fabric, and thereby produce an address signal to a stitch control data memory 12 for reading out therefrom the needle amplitude control data PDB and the fabric feed amount control data PDF of one of the selected stitch patterns as designated by the pattern number memory 9. A calculator circuit 13 is operated in response to the stitch control data PDB and PDF supplied from the memory 12, the control data supplied from the amplitude adjusting unit 6 and one of the base line control signals L, R and M, to thereby determine the base line and calculate the stitch control data to adjust the patterns in reference to the determined base line. The data thus calculated by the calculator circuit 13 are then given to a needle motion control unit 14 and a fabric feed control unit 15 for actual stitching operation. The pattern number control unit 7 will produce address signal TA for different groups of stitch patterns, depending upon the specific base lines L, M and R. Thus, the base line data memory 8 stores the left, right and middle base line control data, and is operated in response to the address signal TA to selectively issue therefrom one of the leftmost base line control data (l'), the rightmost line control data (r) and the middle line control data (m). An exclusive OR circuit 16 has inputs effected by one of the base line control data (l), (r) and (m), the inverting signal TO and the monogram signal MN, to thereby produce the "H" level leftmost base line designating signal (l') when a stitch pattern having the leftmost base line has been designated. The signal (l') will be connected to the set terminal (S) of a flip-flop circuit 17. In the same manner, the "H" level rightmost base line designating signal (r') is produced from an AND circuit 18 to the set terminal (S) of a flip-flop circuit 19, when a stitch pattern having the rightmost base line is designated by the address signal TA from the control unit 7. In case that a stitch pattern is selected having the middle base line, the "H" level middle base line designating signal (m') is produced from an AND circuit 20, which is then connected to the set terminal (S) of a flip-flop circuit 22 via an OR circuit 21. Invertors 23 and 24, a NOR circuit 25 and exclusive OR circuit 26 are provided so that one of the base line designating signals will be applied while taking into consideration the designated condition of the second memory switch 4. A flip-flop circuit 27 is responsive to the monogram signal MN received at the set terminal (S) thereof when a monogram letter stitch pattern is included in the selected combination of the stitch patterns as shown in FIG. 3B. It functions to make the leftmost base line dominant while making ineffective the rightmost base line designating signal (r') and the middle base line designating signal (m') of the other patterns via AND circuits 18 and 20, respectively. Although not shown in FIG. 2, the flip-flop circuit 27 has the set terminal connected to the cancel switch 5 and is thereby reset by operation of the latter to cancel the monogram letter stitch pattern from designation. Respective flip-flop circuits 17, 19 and 22 have their respective set terminals (S) connected to the leftmost base line designating signal (l'), the rightmost base line designating signal (r') and the middle base line designating signal (m') respectively. With this arrangement, one of the circuits 17, 19 and 22 will be selectively set responsive to one of the base line designating signals, thereby producing a corresponding "H" level for one of the base line signals (L), (R) and (M) at the input to the calculator circuit 13. The of setting and resetting these flipflop circuits 17, 19 and 22 under various conditions when they receive one of the base line designating signals (l'), (r') and (m') to carry out the stitching operation are determined by the logical circuits provided. More particularly, the first condition is that, if all of the selective stitch patterns have the same and common base line designating signal (l'), (r') or (m'), then one of the flip-flop circuits will remain to be set whereas the other two flip-flop circuits will be reset. Second, if at least one monogram letter stitch pattern is selected to produce the "H" level left-hand base line designating signal (l') and the monogram signal MN, the flip-flop circuit 17 is dominantly set while the other two flip-flop circuits 19 and 22 are reset. The last condition is that, if the selected stitch patterns include those having the leftmost base line and the rightmost base line which means that there will be produced the "H" level left-most base line designating signal (l') and the "H" level rightmost base line designating signal (r') during the stitching operation of the selected combination of the stitch patterns, then only the flip-flop circuit 22 is set, the other two flip-flop circuits 17 and 19 being reset. The connection between the AND circuits 28, 29 and 30 and the set and rest terminals of the flip-flop circuits 17, 19 and 22 respectively are provided for fulfilling the above described three conditions of the logical operation circuits.

The operation of the electronic sewing machine of the invention will be described in reference to FIGS. 3A–3D: A floral stitch pattern as illustrated in FIG. 3A will be produced alone in such manner that the laterally extending straight stitch (which corresponds to the ground in this pattern) is controlled to coincide with the leftmost base line (L). The height of the floral pattern design is adjustably determined by operation of the dial (*6a*). In this example, the switches 1 and 3 are so operated as to select a floral pattern as shown in FIG. 3A in the normal direction (which is preset). In response to the address signal of the floral pattern from the pattern number control unit 7, the base line control data memory 8 will produce the "H" level leftmost base line control data (l). Thus, the "H" level leftmost base line designating signal (l') is supplied from the output of the exclusive OR circuit 16 to thereby set the flip-flop circuit 17. Subsequent operation of the pattern selecting switches 1 and the inverting memory switch 4 will designate the same floral pattern to be formed in the inverted condition to complete a pair of the floral patterns as shown in FIG. 3A. The leftmost base line designating signal (l') remains unchanged to be at the "H" level and the inverting signal TO is made "H" level due to actuation of switch A. Thus, the "H" level rightmost base line designating signal (r') is given input via NOR circuit 25, exclusive OR circuit 26, and AND circuit 18 to the set terminal (S) of the flip-flop circuit 19. With flip-flop circuits 17 and 19 both set the flip-flop circuit 22 will receive a set signal via the AND circuit 29 and the OR circuit 21. Also, the flip-flop circuits 17 and 19 are respectively reset by the output of OR circuit 21 via the and circuits 28 AND 30. Thus, the calculator circuit 13 will thereafter be operated in response to the middle base line signal (M) from the flip-flop circuit 22, to produce a pair of floral patterns referenced to the middle base line (M). According to the invention, if such a pair of floral patterns are produced with a reduced needle swing because of manipulation of the adjusting dial *6a*, all the patterns are reduced in reference to the middle base line (M) rather than their respective former base line. As a result, the completed patterns will manifest a beautiful appearance and a natural feeling, as shown in the righthand portion of FIG. 3A.

Further, specifically referring to FIG. 3B, a pair of floral patterns as shown in FIG. 3A are followed by a selected combination of monogram letter stitch patterns to form "SEW". Up to this point, as explained in the just preceding discussion, middle base line M dominates. However, this is altered when monograms are selected. Specifically, the selective operation of the switches 1 and 3 to select the first monogram "S" will cause the unit 7 and the memory 8 to produce the "H" level for the leftmost base line (l) and the "H" level for the monogram signal MN respectively. Consequently, the flip-flop circuit 17 is set whereas the flip-flop circuit 22 is reset to inhibit signal M. The calculator circuit 13 is then operated in response to the leftmost base line signal (L), to thereby produce the selective combination of a pair of the floral patterns and the monogram letter patterns referenced to the same base line, that is the leftmost base line, as shown in FIG. 3B.

In the example shown in FIG. 3B, the monogram letter stitch patterns follow the floral pattern designation at which stage the flip-flop circuit 22 is set, and the monogram letter stitch pattern designation will cause the flip-flop circuit 22 to be reset. When the monogram stitch pattern designation is followed by some pattern having the rightmost base line, the flip-flop circuit 19 will not be set because the set signal from circuit 27 input to AND circuit 18 via inverter 24 inhibits AND circuit 18 from passing an "H" level signal to the input of flip-flop 19. Thus, flip-flop 17 remains set and the L base line signal dominates. On the other hand, when some pattern having the rightmost base line preceeds the monogram, flip-flop circuit 19 is set. The subsequent monogram designation will set circuit 27 and inhibit AND circuit 18 so that the "H" level signal for r' is removed. The monogram designation will also cause the flipflop circuit 17 to set, and thereby resetting the flip-flop circuit 19 via the AND circuit 29, the OR circuit 21 and the AND circuit 30. The flip-flop circuit 17 will remain to be set despite receiving the resetting signal via the AND circuit because the "H" level signal at its input remains 28. Therefore, the combination stitch patterns including one or more of monogram letter stitch patterns can, in any way, be produced in reference to the same base line, that is the leftmost base line (L).

Figure 3C:
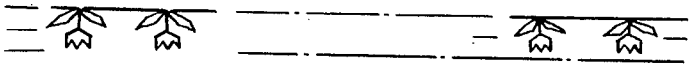

When the switches 1 and 4 are operated to invert the patterns as shown in FIG. 3C, the "H" level leftmost base line data (l) supplied from the base line memory 8 and the "H" level inverting signal TO supplied from the control unit 7 will cooperated to cause the calculator circuit 13 to give the "H" level rightmost base line designating data (r'). Thus, the successive stitching operation becomes ready for producing the combination pattern in reference to the rightmost base line, as shown in FIG. 3C.

Figure 3D:
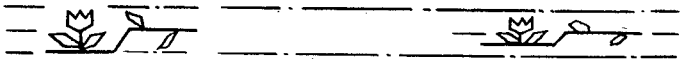

Alternatively, when the pattern having the leftmost base line is firstly selected to set the flip-flop circuit 17, and is followed by selection of another pattern having the middle base line to produce the "H" level rightmost base line data (m), the flip-flop circuit 22 will be set, to thereby reset the flip-flop circuit 17 via the AND circuit 28. As the result, the calculator circuit 13 is caused to give the middle base base line signal (M) for producing the combination patterns in reference to the middle base line as shown in FIG. 3D.

While the invention has been described in conjunction with a specific embodiment thereof, it is to be understood that many different modifications and variations may be made without departing from the spirit and scope thereof.

What is claimed is:

1. In an electronic sewing machine having stitching means including a needle swingable laterally of a fabric feeding direction in an amplitude extending between a left position, through a middle position, to a right position and vertically reciprocated to penetrate a fabric to be sewn to make stitches, a fabric feeding device operated in a timed relation with the needle to transport the fabric relative to the needle, and actuating means coupled to the stitching means for operating the needle and fabric feeding device, a stitch control means comprising:

first means for storing a plurality of available stitch patterns;

second means for storing a base line for each stored stitch pattern, the swinging amplitude of the needle being referenced to the base line associated with each stitch pattern, each stored base line corresponding to one of said left, middle and right positions;

means coupled to said first and second means to select a desired stitch pattern and its associated base line;

third means coupled to said first means for storing a plurality of selected stitch patterns for stitching said selected stitch patterns in sequence;

fourth means coupled to said second means for establishing one base line for every sequence of a plurality of selected stitch patterns including means for outputting to the actuating means only the middle base line whenever patterns having left and right base lines, respectively, are selected.

2. The stitch control means of claim 1, further comprising a needle swing amplitude adjustment means coupled to said actuating means for adjusting the size of the stitched pattern, said actuating means varying the size with reference to the base line established by said fourth means.

3. The stitch control means of claim 1, wherein said third means comprises means coupled to said first means operable to store the inverse of an available stitch pattern.

4. The stitch control means of claim 1, wherein said outputting means comprises a first logic circuit means corresponding to each of the three possible base lines provided by the second means, said logic circuit being coupled between said second means and the actuating means, said first logic circuit means outputting a signal representative of its respective base line when only a pattern corresponding to that base line is selected, second logic circuit means coupled to the first logic circuit means for generating an inhibit signal when patterns corresponding to both right and left base lines are part of a selected sequence of stitched patterns, third logic circuit means responsive to said inhibit signal to block the first logic circuit means from passing signals representative of the right and left base lines and generating the output of only a signal representative of the middle base line.

5. The stitch control means of claim 4, wherein said fourth means comprises means coupled to the pattern selecting means for generating a monogram signal when a monogram pattern is selected to disable the third logic circuit means and for controlling the first logic circuit means to output only a signal representative of the base line corresponding to said monogram.

6. The stitch control means of claim 1, wherein said fourth means comprises means coupled to the pattern selecting means for generating a monogram signal when a monogram pattern is selected to disable said outputting means and to output to said actuating means a signal representative of only the base line corresponding to said monogram pattern regardless of the base line corresponding to other selected patterns of a sequence of which the monogram pattern is a part.

7. An electronic sewing machine having stitch forming instrumentalities including a needle swingable laterally of a fabric feeding direction and vertically reciprocated to penetrate a fabric to be sewn to make stitches, and a fabric feeding device operated in a timed relation with the needle to transport the fabric with respect to the needle, comprising:

first memory means (12) for storing stitch control data for a number of different patterns which may be sequentially read out to control the needle swinging amplitude and the feed amount to form the stitches of a selected pattern, said different patterns being normally stitched while the needle is swinging in reference to the individual needle positions of predetermined right, left and center reference needle positions;

pattern selecting means including a plurality of switches selectively operated to give pattern numbers for selected patterns;

second memory means (9) for sequentially storing a plurality of pattern numbers of the patterns selected by the pattern selecting switches to be sequentially stitched, said second memory, upon storing said pattern numbers, addressing said first memory (12) to sequentially read out the stitch control data for the selected patterns;

function switch means including first switch means (3) operated in connection with said pattern selecting switches to sequentially store a plurality of pattern numbers in said second memory, and second switch means (4) operated in connection with said pattern selecting switches to produce a signal to invert a selected pattern in the direction transversely of the fabric feeding direction;

third memory means (8) for storing data defining reference needle positions including said left, right and center reference needle positions each specific to the patterns stored in said first memory means (12);

control means (7) operated in response to the selective operation of said pattern selecting switches and to the operation of said first function switch means (3) to store the selected pattern numbers in said second memory means (9), said control means simultaneously producing different address signals (TA) in dependence upon the reference needle positions each inherent in the selected patterns, said address signals causing said third memory means (8) to produce the corresponding reference needle position defining signals (m,r,l), said control means being operated in response to the operation of said second function switch means (4) to produce a pattern inverting signal (TO);

logic operation circuit means (17,19,22) operated in response to said reference needle position defining signals and said pattern inverting signal to make effective a specific one of said reference needle position defining signals, said specific signal defining said center reference needle position to be common to said patterns selected in series; and calculating means (13) operated in response to the stitch control data read out from said first memory means (12) and to said specific signal made effective at said logic operation circuit means to calculate and produce modified control data for controlling the formation of said selected patterns while said needle is swinging in reference to said center reference needle position.

8. An electronic sewing machine as defined in claim 7, further comprising needle position adjusting means (6) selectively operated to provide a needle position operating signal to said calculating means (13) for adjusting the needle position with a common variation rate with respect to each of the stitches of the selected patterns to be sequentially stitched.

9. An electronic sewing machine having stitch forming instrumentalities including a needle swingable laterally of a fabric feeding direction and vertically reciprocated to penetrate a fabric to be sewn to make stitches and a fabric feeding device operated in a timed relation with the needle to transport the fabric with respect to the needle, comprising:

first memory means (12) for storing stitch control data for a number of different patterns which may be sequentially read out to control the needle swinging amplitude and the feed amount to form the stitches of a selected pattern, said different patterns being normally stitched while the needle is swinging in reference to the individual needle positions;

pattern selecting means including a plurality of switches selectively operated to give pattern numbers for selected patterns including monogram patterns;

second memory means (9) for sequentially storing a plurality of pattern numbers of the patterns selected by the pattern selecting switches to be sequentially stitched, said second memory, upon storing said pattern numbers, addressing said first memory means (12) to sequentially read out the stitch control data for the selected patterns;

function switch means including first switch means (3) operated in connection with said pattern selecting switches to sequentially store a plurality of pattern numbers in said second memory;

third memory means (8) for storing data defining reference needle positions including said left, right and center reference needle positions each specific to the patterns stored in said first memory means (12);

control means (7) operated in response to the selective operation of said pattern selecting switches and to the operation of said first function switch means (3) to store the selected pattern numbers in said second memory means (9), said control means simultaneously producing different address signals (TA) in dependence upon the reference needle positions each inherent in the selected patterns, said address signals causing said third memory means (8) to produce the corresponding reference needle position defining signals (m,r,l), said control means being operated in response to the operation of pattern selecting switches for selecting said monogram patterns to produce a monogram signal (MN);

logic operation circuit means (17,19,22) operated in response to said reference needle position defining signals and said monogram signal to make effective a specific one of said reference needle position defining signals, said specific signal defining said left reference needle position to be common to said patterns selected in series; and calculating means (13) operated in response to the stitch control data read out from said first memory means (12) and to said specific signal made effective at said logic operation circuit means to calculate and produce modified control data for controlling the formation of said selected patterns while said needle is swinging in reference to said left reference needle position.

10. An electronic sewing machine as defined in claim 9, further comprising needle position adjusting means (6) selectively operated to provide a needle position operating signal for adjusting the needle position with a common variation rate with respect to each of the stitches of the selected patterns to be sequentially stitched.

* * * * *

UNITED STATES PATENT AND TRADEMARK OFFICE

CERTIFICATE OF CORRECTION

PATENT NO. : 4,599,962
DATED : July 15, 1986
INVENTOR(S) : T. KONGOH et al

It is certified that error appears in the above-identified patent and that said Letters Patent is hereby corrected as shown below:

COLUMN 2, lines 24-28, delete the sentence reading "The memory switch....as shown in FIG. 3B."

COLUMN 3, line 50, after "respectively", insert --, as explained below--;

line 59, after "..one of the", insert --flip-flop--;
line 64, start a new paragraph with "The";
line 64, before "setting", delete "of";
line 64, delete "these" and insert --of--;

COLUMN 4, line 47, change "Switch A" to --Switch 4--;
line 48, delete "given";
line 55, change "and" to --AND--.

Signed and Sealed this
Seventeenth Day of May, 1988

*Attest:*

*Attesting Officer*

DONALD J. QUIGG

*Commissioner of Patents and Trademarks*